US005090733A

United States Patent [19]

Bussiere

[11] Patent Number: 5,090,733

[45] Date of Patent: Feb. 25, 1992

[54] MOTIVATIONAL PRINTED PRODUCT

[76] Inventor: R. Bussiere, P.O. Box 307 Vonda, Saskatchewan, Canada, S0K 4N0

[21] Appl. No.: 644,289

[22] Filed: Jan. 22, 1991

[51] Int. Cl.[5] ..... B42D 15/00; G09D 3/00

[52] U.S. Cl. ..... 283/2; 40/107; 283/105

[58] Field of Search ..... 283/62, 2, 3, 4, 105; 40/107, 120, 121

[56] References Cited

U.S. PATENT DOCUMENTS

| | | | |
|---|---|---|---|
| 823,702 | 6/1906 | Schwarz | 283/2 |
| 964,967 | 1/1910 | Hallam | 40/121 |
| 1,070,084 | 8/1913 | Townsend | 283/4 |
| 1,564,997 | 12/1925 | Baker | 283/2 X |
| 1,594,563 | 8/1926 | Robinson | 283/2 |
| 2,582,355 | 1/1952 | Ratner | 283/2 |
| 2,731,746 | 1/1956 | Newman | 283/2 |
| 2,831,278 | 4/1958 | Myers | 40/107 |
| 4,043,573 | 8/1977 | Griffin | 283/2 |
| 4,793,634 | 12/1988 | Alloggiamento | 283/2 |
| 4,798,402 | 1/1989 | Pazicni | 283/2 |
| 4,902,042 | 2/1990 | Rassi | 283/2 |
| 4,947,564 | 8/1990 | Reece et al. | 283/2 X |
| 5,016,917 | 5/1991 | Dubner et al. | 283/2 X |

FOREIGN PATENT DOCUMENTS

| | | | |
|---|---|---|---|
| 27766 | of 1911 | United Kingdom | 40/121 |
| 236457 | 7/1925 | United Kingdom | 40/121 |

*Primary Examiner*—Paul A. Bell

*Attorney, Agent, or Firm*—Adrian D. Battison; Stanley G. Ade; Murray E. Thrift

[57] ABSTRACT

A motivational product is provided in the form of a chart which has a plurality of rectangles defining consecutive days for daily motivational effect upon the user. Each rectangle is associated with a label which carries either an "action" for the day or a "thought" for the day. The combination of a thought which requires to be philosophically considered by the user together with a daily action to be physically undertaken by the user is particularly motivational in character. The labels can be applied onto the rectangles on the daily basis to modify an illustration covering the chart from an initial characteristic to a modified characteristic which encourages the user to complete the task over the cycle of days defined by the rectangles provided.

15 Claims, 2 Drawing Sheets

MOTIVATIONAL PRINTED PRODUCT

BACKGROUND OF THE INVENTION

This invention relates to a motivational printed product of a type which carries a series of indicia each related to a calendar period for example a day and each constituted by a motivational statement or saying.

Many calendars particularly of the book form have printed indicia associated with each page which are for example quotations or sayings of an interesting nature, jokes or cartoons or in some cases motivational material.

While these calendars are interesting or mildly amusing, they do not seriously motivate the user toward self improvement and the main function is not intended as such.

Various designs of calendar to assist the user to complete scheduled tasks or the like have previously been proposed. Examples are shown in U.S. Pat. No. 1,070,084 (Townsend), U.S. Pat. No. 823,702 (Schwartz), U.S. Pat. No. 1,594,563 (Robinson), U.S. Pat. No. 2,731,746 (Newman), U.S. Pat. No. 4,043,573 (Griffin), U.S. Pat. No. 4,798,402 (Pazicni) and U.S. Pat. No. 4,902,042 (Rassi).

Rassi simply discloses a calendar in which portions of the pages can be removed leaving the remainder of the calendar for use as a separate book.

Pazicni discloses a foldable calendar construction of a type which allows full and half pages to be exposed giving area for statements of priority to be entered in writing on the document.

Newman discloses a calendar system in which pieces can be torn away.

Griffin discloses a note pad construction in which pieces can be torn away to indicate those actions which have been completed.

Robinson discloses a laundry calendar which includes an area for listing in writing laundry to be carried out.

Schwartz discloses a combined date and note block on which portions of a page can be torn away.

Townsend discloses a calendar with additional pads acting as reminders for actions to be undertaken.

However none of these calendars are motivational in the sense that they are not directed to a series of self improvement steps to be undertaken by the user, nor do they lend themselves to repeated daily actions which supplement and assist the motivational characteristic involved.

SUMMARY OF THE INVENTION

It is one object of the present invention, therefore, to provide an improved motivational printed product of a type which has as a main objective a self improvement motivational aspect involving repeated daily enhancement of the motivation.

According to the first aspect of the invention, therefore, there is provided a printed product for motivation of a user comprising support substrate means, means on the support substrate means defining a plurality of calendar periods, said support substrate means carrying for each period first means providing a first printed statement constituting a proposed thought for study by the user and second means providing a second printed statement constituting a proposed action to be undertaken by the user.

According to the second aspect of the invention, therefore, there is provided a printed product for daily motivation of a user comprising supporting substrate means, means on the substrate means defining a plurality of separate locations each associated with a day of a series of days, first means carried on said substrate means defining a first series of printed statements each associated with a respective one of said series of days, second means carried on said substrate means defining a second series of printed statements each associated with a respective one of said series of days, at least one of said first and second series being constituted by a plurality of separate labels each label carrying a respective one of said printed statements.

According to a third aspect of the invention, therefore, there is provided a printed product for motivation of a user comprising supporting substrate means, first means defining on the substrate means a plurality of receiving locations each indicative of a calendar period, second means defining on the substrate means a main pattern overlying and extending across a plurality of said receiving locations, a plurality of adhesive labels each label carrying printed indicia associated with a respective one of the receiving locations, each label carrying printed indicia constituting a motivational statement, and each label carrying a printed pattern portion associated with that portion of the main pattern which lies on the respective location, such that when the label is adhesively applied to the respective location the printed pattern portion on the label cooperates with the main pattern, at least one of the pattern portions being visually distinguished from that portion of the main pattern lying on the respective location such that when all of the labels are applied adhesively to the respective locations, the resultant pattern is visually distinguished from the main pattern.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
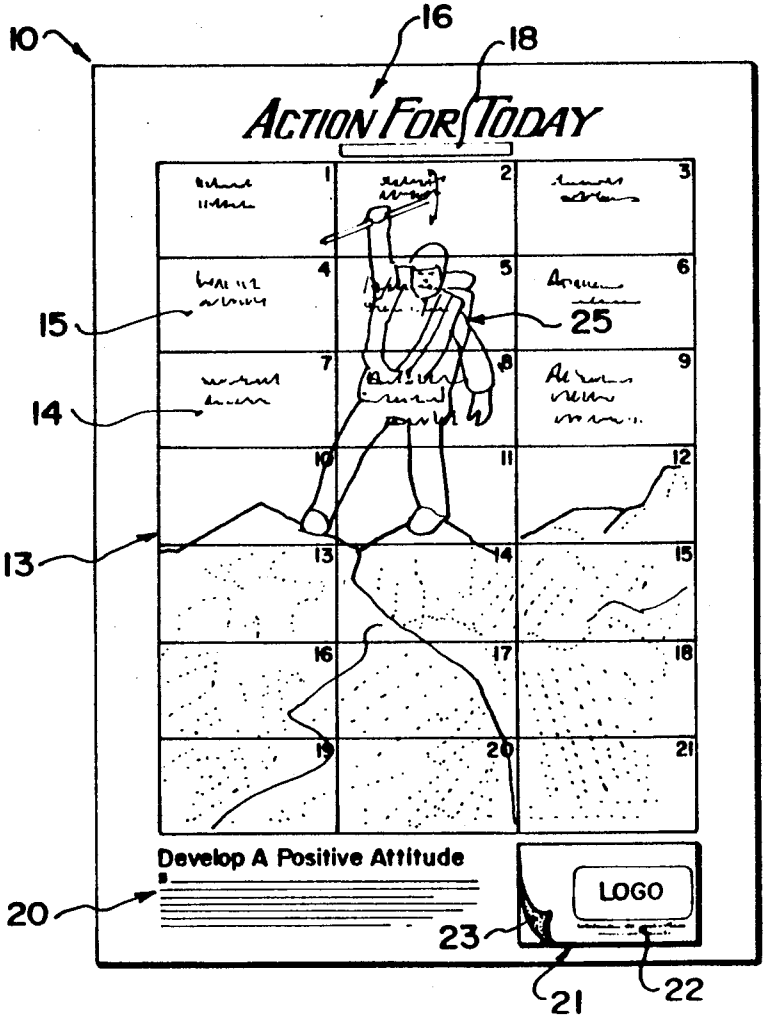
FIG. 1 is a plan view of a first chart forming part of a motivational product.
Figure 2:
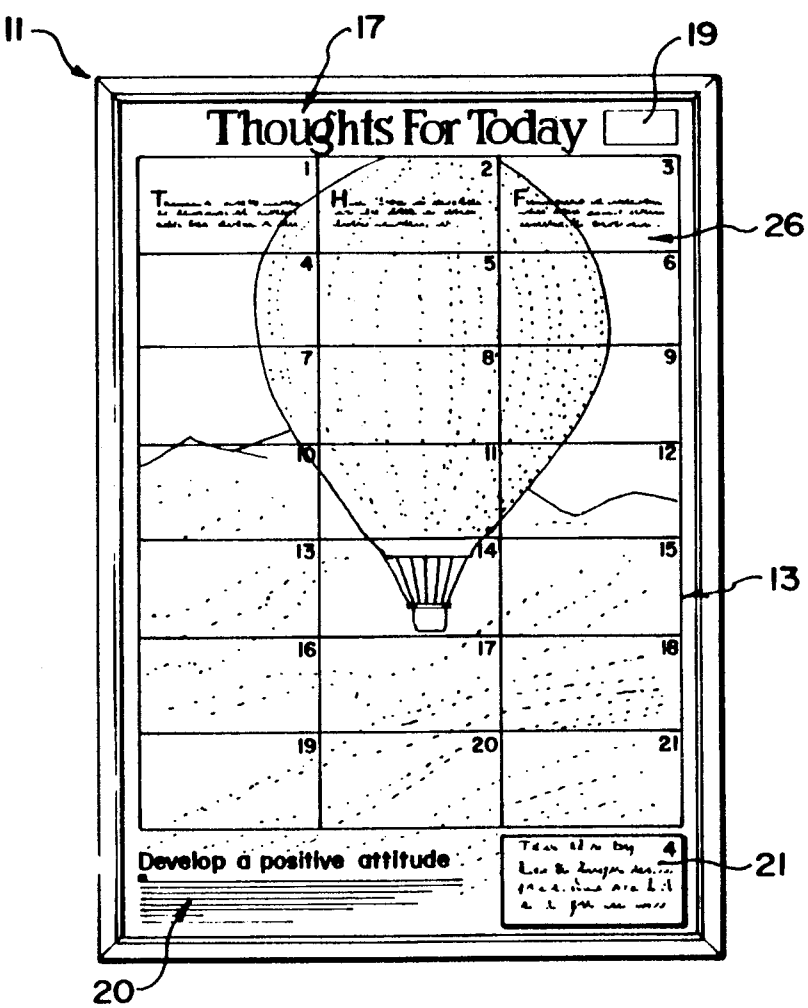
FIG. 2 is a plan view of a second chart forming a second part of the motivational product.

The embodiment shown in FIGS. 1 and 2 comprises a motivational product intended to be used by a person or group of persons to assist in motivating those persons towards a particular goal whether that be self improvement or improvement in the work place, team or other situation.

Much attention has been given in the past to various written works in books, magazine articles and the like aiming towards additional motivation for self improvement.

The present product provides a repeated reinforcement of the motivational effect leading toward a particular goal.

The product is designed so that the motivation is aimed toward a particular end so that all statements and actions involved in the product concerned are generally directed toward the same subject. One example is an improvement in friendship. Other examples could be more specific goals such as weight loss, increased fitness. Others for example in the work place may be directed toward specific goals or generally to improved work ethic and work habits.

The product shown in FIGS. 1 and 2 comprises two parts each of which forms a chart indicated at 10 and 11 respectively. The chart is in most cases simply a flat sheet of card or the like which can be attached to a wall or other suitable location to enable the front face to be readily viewed and reached by the user.

On the front face of the card is a generally rectangular area 13 which is divided into a plurality of rectangles 14, 15 etc. In the examples shown, the large rectangle 13 is divided into twenty one smaller rectangles arranged in three rows of seven of such rectangles. The rectangles are consecutively designated one through twenty one so as to indicate twenty one days which will normally be consecutive.

Although consecutive days are selected in the example shown, other calendar periods may be used for example the product may be directed to weekly events. In addition the days may be not be consecutive and certain days may, for example be omitted.

The device is not however a calendar in the sense that it is not applied to any particular month or other specific calendar period but merely relates to a number of calendar periods which can be used at any time of the year or month and in any year selected.

In the example shown therefore there are twenty one consecutive days.

On each of the charts 10 and 11 is provided a heading which on the chart 10 is indicated at 16 and is constituted by the words "Action for Today". On the chart 11 the heading is indicated at 17 and is constituted by the words "Thoughts for Today".

The chart also carries a further heading 18 or 19 which relates to the subject matter with which the particular chart is concerned as explained above.

At a lower part of the chart underneath the rectangular area 13 is provided a further set of printed information generally indicated at 20 which constitutes a set of instructions for the product and including further motivational statements and particularly the phrase "Develop a Positive Attitude".

Overlaid upon the rectangular area 13 of each of the charts is provided printing in the form of a picture which spreads over the whole of the area 13 irregardless of the dividing lines formed in a separate rectangular areas 14 and 15. In the example of chart 10, the picture illustrated includes the peak of a mountain and in the base or main picture illustrated simply on the rectangular area 13 there is no climber.

At the bottom right hand corner of the chart as indicated at 21 there is provided a series of twenty one stickers or labels arranged consecutively one on top of the other with each label having a front printed face 22 and a rear adhesive surface as indicated at 23 in which one corner of the upper most label is pulled ready to be removed. Each label carries a number which is associated with the consecutive numbers applied on the rectangles 13, 14 etc. Each label carries a statement or phrase for study by the user on the day concerned.

Thus in use the user will remove a label from the pile or stack of labels 21 and will apply it to the associated rectangle within the larger rectangle 13. This exposes a statement or phrase for use on the particular day which will be studied by the user.

In addition to the statement or phrase on the front face of the sticker or label is also a portion of a picture or illustration which is associated with the main illustration on the rectangle 13. Thus each label carries a portion of the main illustration but a portion which in some cases is slightly different from the main illustration. In this way the resultant effect when the label is applied is to slightly modify the main illustration. Thus leading to a visual distinction between the original main illustration and the finished illustration comprised of the series of labels. In the embodiment shown the labels have a size which is identical to the size of the associated rectangle so that when finished the whole illustration is provided by the labels arranged edge to edge.

In the example shown in FIG. 1, the initial illustration without the labels applied comprises simply a mountain peak forming part of an attractive scenic view. Basically the labels applied carry the same scenic view but in addition a climber indicated at 25 is added to the scenic view in oppose of achievement at reaching the peak.

Thus as each label is added on a daily basis, the picture is gradually modified to a situation where the resultant picture provides a feeling of achievement. Preferably the arrangement of consecutive labels is such that the final label completes the last part of the achievement or change in the main illustration.

In the example shown in FIG. 2, the first row of labels has been applied as indicated at 26. In this case it will be noted that instead of significantly changing the main illustration, the labels are printed in brighter more distinctive colours or lines so that the main illustration gradually becomes brighter as more and more labels are applied on the daily basis.

The two charts shown in FIGS. 1 and 2 are associated together in a set of the charts which are either directly connected together along a central hinge or simply supplied together for attachment at a suitable location for using and viewing by the user.

The chart 11 carries twenty one statements or phrases each of which constitutes a "Thought for Today". Thus the statement applied on each label comprises a philosophical thought for study by the user of a type which gives the user additional insight, information or analysis of the subject with which the chart is concerned. Thus for example a chart which is concerned with halting the addiction of smoking could include a series of "thoughts" providing more information concerning the effects of smoking.

The chart 10 includes a series of labels each of which is headed "Action for Today". Each label therefore carries a statement which constitutes an instruction or intended action which the user will physically and actually carry out during the day. In one example of a motivational action on self improvement the action might be "visit a friend today whom you have not contacted for some time" this therefore constitutes an instruction or action upon the user which the user is expected to physically carry out during that day as opposed to the "thoughts" which are merely for philosophical consideration, study or analysis.

The combination therefore of the "thoughts", the "actions" together with the motivational effect provided by the "achievement" of completing the twenty one day cycle provides a very effective motivational tool for self improvement either personally, in a work place or as a team.

Figure 3:
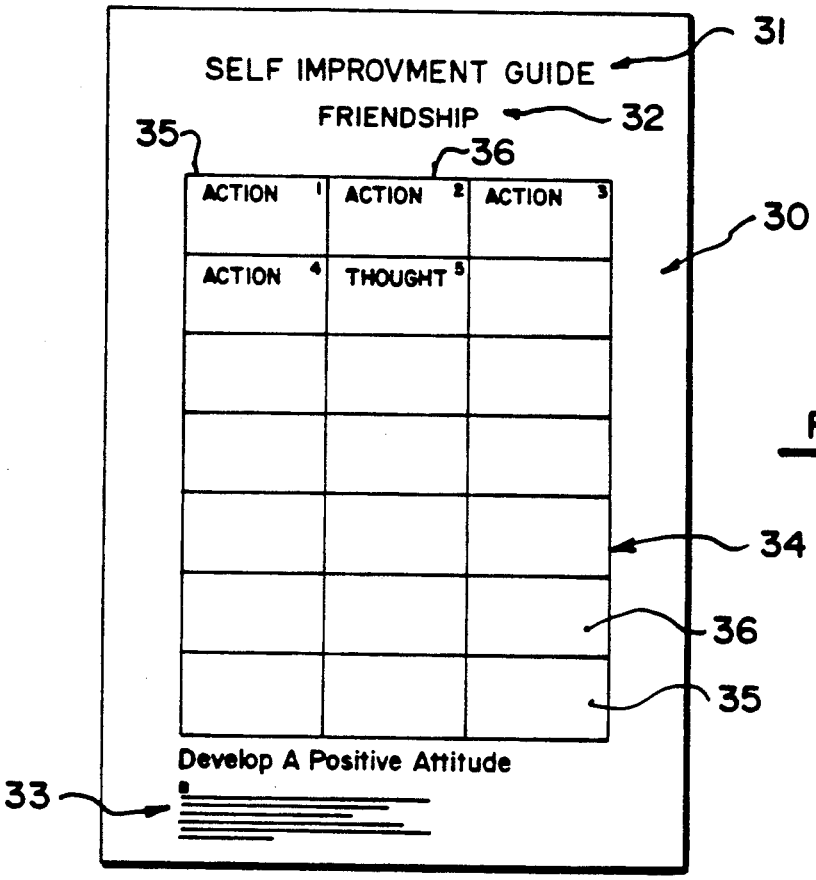
FIG. 3 is a plan view of an alternative arrangement of motivational product according to the invention.
Figure 4:
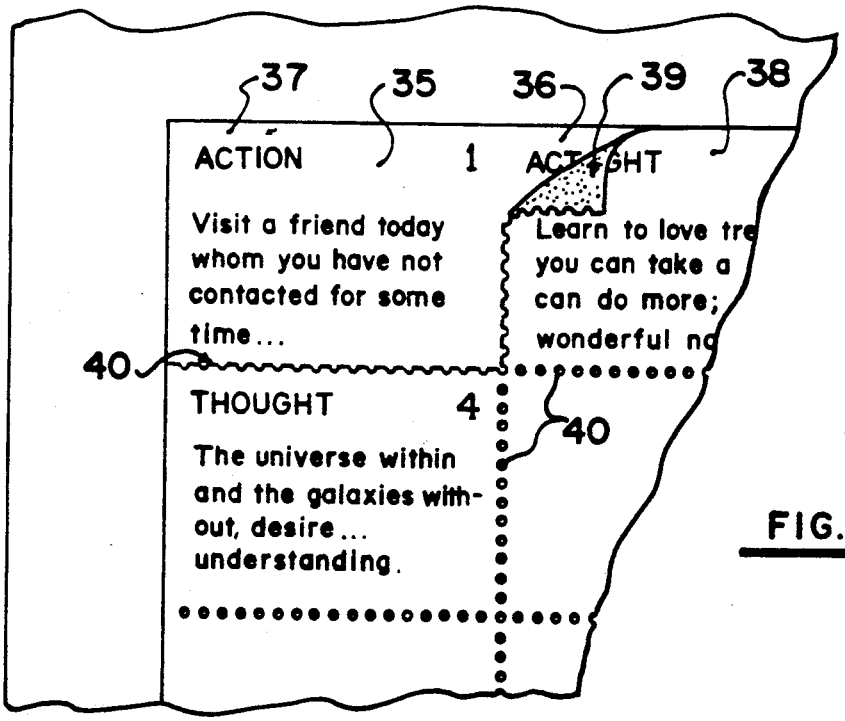
FIG. 4 is a plan view on an enlarged scale of one part of the product of FIG. 3.

Turning now to FIGS. 3 and 4, there is shown a similar motivational product which employs again the same daily cycle of twenty one days as set forth in FIGS. 1 and 2. In addition it employs the same "thought" and "action" concept of motivation used on the daily basis.

In this embodiment, however, there is provided a chart 30 which in this case is a single chart with suitable headings 31 and 32 providing details of the motivation and the subject with which the motivation is concerned. Furthermore the chart includes the statement of instructions 33 similar to that in the charts of FIGS. 1 and 2.

Furthermore there is a rectangular area 34 defined on the front of the chart divided into twenty one rectangles 35, 36 etc.

As best shown in FIG. 4, the rectangles 35 and 36 comprise two layers including a backing layer 37 forming the rear layer of the chart and a front layer 38 which is of a thinner paper material which can be torn away from the backing layer 37. The front layer 38 includes an adhesive rear surface 39 and is divided into the rectangles 35, 36 by lines of perforation indicated at 40. As shown thus in FIG. 4 some of the perforations have been torn so that a first one of the front sheets has been torn away from the rectangle 35 whereas the next lower rectangle the front sheet remains intact and the next rectangle to the right again the front sheet remains intact. In this case however the corner is turned over to commence the removal process in showing the adhesive layer 39 on the rear surface. The adhesive layer is of the type which can be removed and reapplied so that the label defined by the front sheet can be removed and applied to another surface for example a mirror or the desk of the user to act as a reminder.

As shown in FIG. 4, each rectangle has associated therewith a respective "action" and a respective "thought". The "action" is applied to one of the layers whereas the "thought" is applied to the other of the layers.

Thus the user is encouraged on a daily basis to remove the front layer from the rectangle associated with the day concerned to reveal both the "thought" and the "action" for the day concerned. The user is then faced with the philosophical consideration of the thought and an action which should be undertaken at some time during the day.

As stated above the combination of the action and thought are particularly motivational in character.

As shown in FIG. 3 all of the "thoughts" are visible on the chart at the beginning of the period and the "actions" become visible as the days progress. This can of course be reversed so that the "action" is then part of a separate label or sticker which can be removed and carried by the user to remind him of the action for the day.

In addition a further arrangement (not shown) may be provided in which both the action and thought are hidden until the day concerned for example by presenting the printing on the undersurface of the upper layer so that it is only revealed when it is torn away and reversed.

The same technique of motivation using the modification of the illustrations may also be used by providing a first illustration on the exposed face of the upper layer and a second illustration or pattern or colouring on the exposed face of the lower layer which is then revealed on the daily basis by removal of the upper layer.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A printed product for motivation of a user comprising support substrate means, means on the support substrate means defining a plurality of calendar periods, said support substrate means carrying for each period first means providing a first printed statement constituting a proposed thought for study by the user and second means providing a second printed statement constituting a proposed action to be undertaken by the user.

2. The printed product according to claim 1 wherein said means defining a plurality of calendar periods defines a plurality of consecutive days.

3. The printed product according to claim 1 wherein at least one of said first and second means is provided as a plurality of separate labels each movable relative to the substrate means.

4. A printed product for daily motivation of a user comprising supporting substrate means, means on the substrate means defining a plurality of separate locations each associated with a day of a series of days, first means carried on said substrate means defining a first series of printed statements each associated with a respective one of said series of days, second means carried on said substrate means defining a second series of printed statements each associated with a respective one of said series of days, at least one of said first and second series being constituted by a plurality of separate labels each label carrying a respective one of said printed statements.

5. The printed product according to claim 4 wherein each of the first series of printed statements is constituted by printed indicia constituting a proposed thought for study by the user.

6. The printed product according to claim 4 wherein each of said second series comprises printed indicia constituting a proposed action to be undertaken by the user.

7. The printed product according to claim 4 wherein at least one of said first and second means comprises a plurality of labels supplies a separate consecutive series of the labels.

8. The printed product according to claim 7 wherein the labels are separately movable.

9. The printed product according to claim 4 wherein the second means directly overlies the first means and wherein the second means is constituted by a plurality of separate labels such that each separate label of the second series can be removed to expose a respective one of the first series.

10. A printed product for motivation of a user comprising supporting substrate means, first means defining on the substrate means a plurality of receiving locations each indicative of a calendar period, second means defining on the substrate means a main pattern overlying and extending across a plurality of said receiving locations, a plurality of adhesive labels each label carrying printed indicia associated with a respective one of the receiving locations, each label carrying printed indicia constituting a motivational statement, and each label carrying a printed pattern portion associated with that portion of the main pattern which lies on the respective location, such that when the label is adhesively applied to the respective location the printed pattern portion on the label cooperates with the main pattern, at least one of the pattern portions being visually distinguished from that portion of the main pattern lying on the respective location such that when all of the labels are applied adhesively to the respective locations, the resultant pattern is visually distinguished from the main pattern.

11. The printed product according to claim 10 wherein the labels are supplied as a separate consecutive series of labels.

12. The printed product according to claim 10 wherein the printed indicia on each label constitutes a proposed thought for study by the user.

13. The printed product according to claim 12 wherein the printed indicia constitutes a proposed action to be undertaken by the user.

14. The printed product according to claim 10 wherein the resultant pattern is distinguished from the main pattern by a brightness of coloration.

15. The printed product according to claim 10 wherein the resultant pattern is distinguished from the main pattern by an additional element added to the main pattern which is indicative of an achievement related to the main pattern.

* * * * *